US006201191B1

(12) United States Patent
Yorita et al.

(10) Patent No.: US 6,201,191 B1
(45) Date of Patent: Mar. 13, 2001

(54) SOLID DC CABLE

(75) Inventors: Jun Yorita; Ryosuke Hata; Hiroshi Takigawa, all of Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/069,101

(22) Filed: Apr. 29, 1998

(30) Foreign Application Priority Data

Oct. 29, 1907 (JP) ..... 9-314519
Apr. 29, 1997 (JP) ..... 9-126353
Nov. 18, 1997 (JP) ..... 9-335155

(51) Int. Cl.[7] ..... H01B 7/00
(52) U.S. Cl. ..... 174/110 R; 174/120 R; 174/120 FP
(58) Field of Search ..... 174/110 R, 105 R, 174/119 C, 120 R, 120 C, 120 FP, 36

(56) References Cited

U.S. PATENT DOCUMENTS 3,617,377 * 11/1971 Isshiki ..... 117/224
3,833,443 * 9/1974 Naseth et al. ..... 156/55
3,844,860 * 10/1974 Edwards ..... 156/53
4,001,760 * 1/1977 Howie et al. ..... 338/238
4,029,206 * 6/1977 Mykleby ..... 206/400
4,033,028 * 7/1977 Howie et al. ..... 29/611
4,237,334 * 12/1980 Kojima et al. ..... 174/25
4,326,094 * 4/1982 Hunn ..... 174/23 R
4,467,010 * 8/1984 Shil et al. ..... 428/212
4,470,898 * 9/1984 Penneck et al. ..... 252/511
4,673,607 * 6/1987 Hata et al. ..... 428/172
4,675,470 * 6/1987 Hata et al. ..... 174/25 R
4,762,965 * 8/1988 Hata et al. ..... 174/23 R
4,859,804 * 8/1989 Hata et al. ..... 174/25
4,964,933 * 10/1990 Hata et al. ..... 156/209
5,481,070 * 1/1996 Hirose et al. ..... 174/120 FP
5,521,010 * 5/1996 Tanaka et al. ..... 428/379

FOREIGN PATENT DOCUMENTS 647 950 A1 4/1995 (EP) .
647950A1 4/1995 (EP) .

* cited by examiner

*Primary Examiner*—Kristine Kincaid
*Assistant Examiner*—William H. Mayo, III
(74) *Attorney, Agent, or Firm*—Pillsbury Madison & Sutro LLP

(57) ABSTRACT

A solid DC cable is made of a conductor having multilayered insulating layer around the outer circumference of the conductor. The insulating layer has a layering configuration selected from one of the following arrangements: (i) a main insulating layer and a low resistance tape layer, where the low-resistance tape layer contains carbon paper that has a volume resistivity which is smaller than that of the main insulating layer; (ii) a main insulating layer containing kraft paper, and a low-resistance insulating layer containing a low resistance kraft paper having a resistivity smaller than the kraft paper of the main insulating layer; (iii) a main insulating layer containing a composite tape, where the tape is contains a laminate of a low-loss plastic film and kraft paper, and a low-resistance insulating layer containing kraft paper having a resistivity lower than the main insulating layer; or (iv) a low-resistance tape layer containing carbon paper described in (i), a low-resistance insulating layer containing the low-resistance kraft paper described in (ii) and a main insulating layer. The low-resistance insulating layer or the low-resistance tape layer is positioned above the conductor in a region where the pressure of the insulating oil becomes negative when a voltage load is cut off.

23 Claims, 7 Drawing Sheets

SOLID DC CABLE

FIELD OF THE INVENTION

The present invention relates to an electrical power cable optimum for long-distance and large-capacity transmission, and particularly relates to a structure of a DC submarine power transmission cable.

DESCRIPTION OF THE RELATED ART

Conventionally, as a long-distance and large-capacity DC cable, there has been used a solid cable (Mass-Impregnated Cable, Non-Draining Cable, or the like) which uses kraft paper as insulating tape material and which is impregnated with high-viscosity insulating oil (for example, 25 to 100 cst at 120° C., and 500 to 2,000 cst at the maximum service temperature (50 to 60° C.) of the cable). The thickness of this insulating tape is, generally, about 70 to 200 $\mu$m because a thin insulating tape is low in mechanical strength, and a large-sized winding machine is required as the number of wound sheets increases.

Unlike an OF cable, an insulating oil is not supplied to a solid DC cable from the opposite ends of the cable. Accordingly, a void is generated because of shortage of the insulating oil in an insulating layer, and the void is apt to be a start point of discharge when it grows up to a harmful size. Such a void is apt to be generated first in an oil gap which is inevitably appears when the insulting tape is wound spirally, and apt to be generated next in porous substances of natural fibers in the insulating tape. The thicker the insulating tape, the larger the oil gap. In a conventional solid DC cable, for example, the voltage was comparatively low to be not higher than 400 kV, and the transmission current was comparatively small to be smaller than 1,000 A. Accordingly, voids apt to be generated in oil gaps just above a conductor, or just above the inner semiconductive layer in case that there applies the inner conductive layer have not been regarded as a problem particularly.

However, plans to transmit large electric power at a long distance through a solid DC cable have come out in succession recently. For example, lines for a transmission voltage of 450 kV or 500 kV or more, and a transmission current larger than 1,000 A have been planned. Under such a high voltage and such a large current, harmful voids formed in an insulating layer particularly just above a conductor could not be ignored.

SUMMARY OF THE INVENTION

It is an object of the present invention to provide a solid DC cable in which even if voids are generated when load is cut off, harmful discharge in the voids can be restrained.

In the present invention, (1) a carbon paper layer having volume resistivity which is one or more figures lower than the volume resistivity of an insulating tape constituting a main insulating layer, (2) a kraft paper layer having volume resistivity which is 70% or less of the volume resistivity of the insulating tape, or (3) the carbon layer of (1) and the kraft paper layer of (2) (which are successively provided from a conductor to the main insulating layer) is provided just above the conductor or just above the inner semi-conductive layer within a region in which the pressure of insulating oil becomes negative when a load is cut off. Preferably, this low-resistivity paper layer is provided also in the outer circumference of the main insulating layer.

DETAILED DESCRIPTION OF THE DRAWINGS

Detailed description of the present invention will be described as follows referring to the accompanying drawings.

Figure 2:
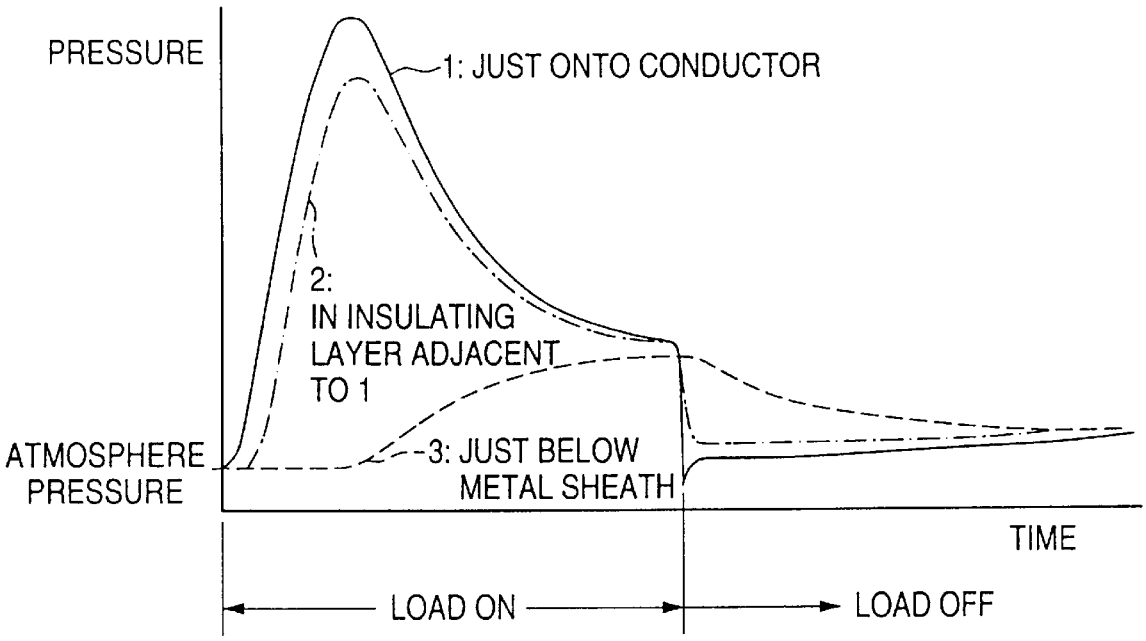
FIG. 2 is a graph showing a change of oil pressure in an insulating layer just above a conductor or just above inner semi-conductive layer in an adjacent to the insulating layer and in an insulating layer just below the metal sheath or just below the outer semiconductive layer when current is applied (LOAD ON) stopped (LOAD OFF)

The development of consideration to complete the present invention will be described below. To examine the mechanism to generate voids when a load was cut off, the present inventors investigated how the pressure of insulating oil changed in every position of an insulating layer in a conventional solid DC power cable with thick kraft paper (the thickness was 70 $\mu$m or more) when a current was cut off after start of supply of the current. FIG. 2 is a graph showing the changes of the oil pressure. In FIG. 2, a line 1 is a change of the oil pressure in the insulating layer (innermost circumference) just above the conductor or just above the inner semiconductor layer in case that there applies the inner semiconductor layer, a line 2 designates a change of the oil pressure in a position which is far away upward from the conductor by a distance corresponding to about 10 sheets of kraft paper, and a line 3 designates a change of the oil pressure just below a metal sheath (outermost circumference) or just below the outer semiconductive layer in case that there applies the inner semiconductor layer.

When a load current is made to flow, first, the temperature of the conductor begins to rise, and the temperature of the insulating layer also rises correspondingly from its inner circumference toward its outer circumference. At that time, the insulating oil expands in proportion to the product of its volume (or unit volume), the thermal temperature expansion coefficient and the temperature rising. The expansion moves in the radial direction toward the outer circumference of the insulating layer so that the expansion partially makes the metal sheath of the outer circumference expand, while makes the pressure of the insulating oil rise. Since the temperature of the insulating oil is lower as a position goes toward the outer circumference immediately after the current is made to flow, the viscosity of the insulating oil is high, and the oil-flow resistance of the same is also high in such a low-temperature portion. Accordingly, the insulating oil is difficult to move. Therefore, the expanded insulating oil on the inner-circumferential side cannot move to the outer-circumferential side immediately, and the oil pressure in the insulating layer rises more sharply as the position is closer to the inner-circumferential side. After that, since the insulating oil moves to the outer-circumferential side as the passage of time, the oil pressure in the insulating layer just above the conductor or just above the inner semiconductor layer in case that there applies the inner semiconductor layer also decreases, and the distribution of the oil pressure in the radial direction of the insulating layer becomes uniform gradually.

When the load current is cut off in this state, the temperature drops suddenly on the conductor at this time. Accordingly, in the insulating layer, the temperature on the conductor side drops sharply, while the temperature on the sheath side drops slowly. Then, the insulating oil begins to shrink. However, since the viscosity of the insulating oil is comparatively high, the insulating oil cannot return from the outer-circumferential side to the inner-circumferential side sufficiently in accordance with the sharp shrink on the conductor side. As a result, negative pressure is temporarily generated particularly in an oil gap in the insulating layer just above the conductor or just above the inner semiconductive layer in case that there applies the inner semiconductive layer, and voids come to appear in that portion. Further, as time passes, the insulating oil in the outer-circumferential side of the insulating layer returns to the inner-circumferential side since the pressure in the outer-circumferential side is positive, so that both the voids and the negative pressure are eliminated.

Generally, a voltage is applied on a transmission line regardless of on/off of a load current. Therefore, if negative pressure occurs in an insulating layer just above a conductor to generate a void when the load is cut off, discharge arises when DC electric stress put on the void exceeds a certain value. This is not desirable for the solid cable.

As has been described above, a void generated when the load is cut off is apt to appear just above a conductor. Therefore, in the present invention, (1) a carbon paper layer having volume resistivity which is one or more figures lower than the volume resistivity of an insulating tape constituting a main insulating layer, (2) a low-resistance kraft paper layer having volume resistivity which is 70% or less of the volume resistivity of the insulating tape, or (3) the carbon layer of (1) and the normal kraft paper layer of (2) (which are successively provided from a conductor to the main insulating layer) is provided just above the conductor or just above the inner semiconductor layer in case that there applies the inner semiconductive layer within a region in which the pressure of insulating oil becomes negative when a load is cut off. Therefore, even if a void appears in the insulating oil just above the conductor or just above the inner semiconductor layer in case that there applies the inner semiconductive layer, and even if this void is large enough to be harmful, the voltage should not be shared with this void portion. The region in which the low-resistance carbon paper and/or normal kraft paper is wound inside the main insulating layer or above (or onto) the conductor may be either the whole or a part of the region in which the pressure of insulating oil becomes negative when the load is cut off.

Here, the role of the low-resistance carbon paper and/or kraft paper wound inside the main insulating layer or above (or onto) the conductor is to have substantially equal thermal resistance against the conductor temperature to that of the insulating tape so as to produce a temperature gradient in the low-resistance carbon paper and/or kraft paper wound inside the main insulating layer or above (or onto) the conductor, though the DC stress large enough to be harmful is not shared with the carbon paper and/or kraft paper. Therefore, as is understood from FIG. 2, a sharp change of the conductor temperature at the time of cutting off the load is relieved largely by this low-resistance carbon paper and/or kraft paper layer inside the main insulating layer or above (or onto) the conductor. Accordingly, a sharp change of temperature is not apt to occur in the main insulating layer on the outer circumference of the carbon paper and/or kraft paper. Accordingly, the shrinkage of the insulating oil is reduced, so that voids are not apt to occur in the insulating layer. In addition, even if voids are generated, the generated positions are concentrated in the low-resistance carbon paper and/or kraft paper layer around the main insulating layer close to the conductor.

It can be considered that instead of this low-resistance carbon paper and/or kraft paper, material having no electric field (electric stress) applied thereto, for example, a copper tape is wound around the main insulating layer. However, in this case, the thermal resistance of the copper tape is too small to produce a temperature gradient in the copper tape layer. Therefore, as a result, a sharp change of temperature and a sharp shrinkage of insulating oil begin in an insulating tape layer just in the outer circumference of the copper tape in the same manner with the conventional cable, so that it is easy to understand that the effect of the present invention cannot be obtained.

First Embodiment

First embodiment according to the present invention will be described as follows.

Generally, in a state where general kraft paper is used as insulating tape and has been impregnated with solid oil, the volume resistivity is about $10^{13}$ Ω·cm or more within the service temperature range. In the case where an electrically insulating composite tape (for example, a plastic tape is polypropylene, trade name: PPLP insulating tape) in which kraft paper is adhered to both sides of a plastic tape is used as the insulating tape, the volume resistivity is about $10^{15}$ Ω·cm or more in the same conditions. Accordingly, carbon paper having a resistivity which is one or more figures lower than the above volume resistivity, for example, having a volume resistivity in a range of from $10^3$to $10^8$ Ω·cm, is used. Since a DC electric field is shared in proportion to resistance in each position of the insulating layer, the DC electric fields is not shared with the low-resistivity carbon layer so that it is possible to restrain discharge in voids.

The region where negative pressure arises in the insulating layer may be obtained by calculation or experiment of trial cables after the service conditions, size and structure of the cable are determined. Generally, it is preferable to make the thickness of the winding of carbon paper be 0.8 mm or more. If the thickness is smaller than 0.8 mm, the insulating tape receives an influence from the shape of the conductor, and a sharp change of conductor temperature when load is cut off as mentioned above cannot be absorbed in the carbon paper layer. Generally, in order to absorb/relieve sufficiently the influence of the portion where the temperature drops suddenly at the time of cutting off of the load, it is more preferable to wrap the carbon paper to an extent of 10% of the thickness of the insulating layer. If the carbon paper layer is increased more than 10% of the thickness of the insulating layer, the total number of wound sheets which is a combination of the carbon paper layer and the insulating tape layer as the main insulating layer becomes large, and the total insulation thickness is also increased. If the number of these wound sheets is increased, a tape wrapping machine is too large in size or the efficiency of working is reduced at the time of manufacturing the cable. In addition, the cable manufactured is large in size wastefully.

Preferably, the thickness of the carbon paper used here is set to be about 50 to 150 $\mu$m. If the thickness is smaller than 50 $\mu$m, the material mechanical strength of the carbon paper is reduced. If the thickness exceeds 150 $\mu$m, an oil gap in the carbon paper layer becomes large unpreferably.

A mode for carrying out the present invention according to the first embodiment will be described below.

Figure 1:
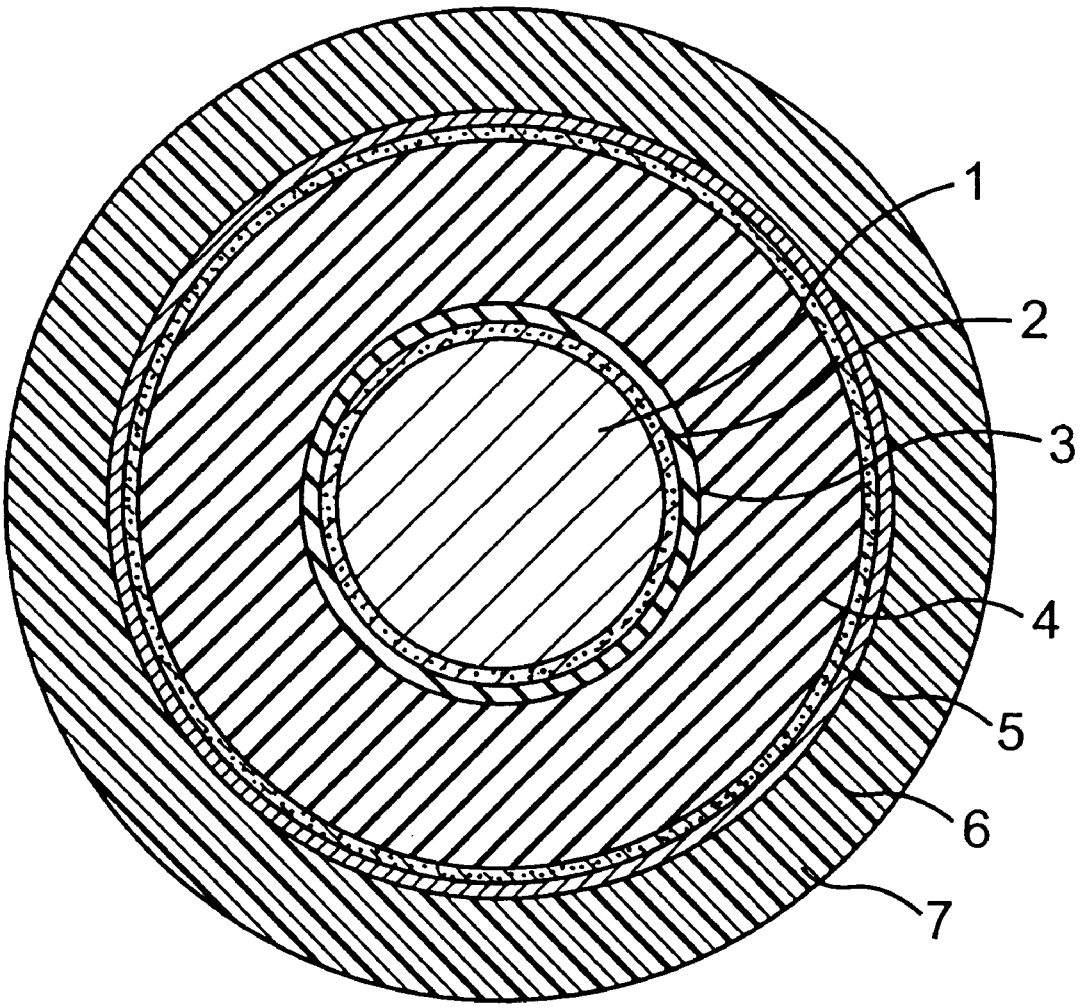
FIG. 1 is a sectional view of a solid DC cable of a first embodiment according to the present invention.

FIG. 1 is a sectional view of a solid DC cable according to the present invention. This cable is constituted by a conductor 1, an inner semiconductive layer 2, a carbon tape layer 3, a main insulating layer 4, an outer semiconductive layer 5, a metal sheath 6 and a plastic jacket in the order from the inner circumference toward the outer circumference. The main insulating layer 4 is formed by wrapping kraft papers or semisynthetic papers in which kraft paper and polyolefin film such as polypropylene film, etc., are integrated. In addition, in the carbon tape layer 3, 10 sheets of carbon tape each having a volume resistivity of $10^6$ Ω·cm and a thickness of 80 $\mu$m are wound.

EXPERIMENTAL EXAMPLE 1

Cables (Examples and Comparative Examples) having a similar structure to that of FIG. 1 were made on trial, and DC breakdown characteristics were examined upon these cables. As to the experimental conditions, start voltage was −200 kV, a step-up condition was −20 kV/3 days, and a load cycle was 8 hour current circulation (70° C.) and 16 hour natural cooling (R.T). The cable structures and the experimental results are shown in Table 1.

TABLE 1

| | | Example 1 | Example 2 | Example 3 | Comp. Ex. 1 |
|---|---|---|---|---|---|
| cable structure | conductor size ($mm^2$) | 800 | 800 | 800 | 800 |
| | number of carbon paper (sheets) (80 $\mu$m thick) | 10 | — | — | — |
| | number of carbon paper (sheets) (130 $\mu$m thick) | — | 7 | 12 | 3 |
| | insulation thickness (mm) | 14.0 | 14.0 | 14.0 | 14.0 |
| | outer diameter (mm) | 62.5 | 62.7 | 64.0 | 61.7 |
| electrical test | DC-BD value (kV/mm) | −1,200 | −1,200 | −1,400 | −800 |

As shown in Table 1, Examples 1, 2 and 3 are superior in the electric breakdown characteristics to Comparative Example 1, and it can be inferred that discharge is restrained even if voids are generated in a portion just above the conductor. Particularly, in Example 3, in which the carbon paper layer was about 10% of the total thickness of the insulating layer, the effect to improve the DC breakdown characteristics was the largest.

As has been described above, according to a solid DC cable of the first embodiment according to the present invention, it is possible to restrain discharge even if negative oil pressure occurs in an insulating layer to thereby generate voids when load is cut off. Accordingly, it is possible to configure a power cable which is high in the electric breakdown strength, and suitable for large-electric power and long-distance transmission.

Second Embodiment

Second embodiment according to the present invention will be described as follows.

Preferably, the resistivity ($\rho_1$) of the low-resistance kraft paper used in a region in which negative oil pressure is produced just above the conductor has a relationship of $0.1\rho_0 \leqq \rho_1 \leqq 0.7\rho_0$ with the volume resistivity ($\rho_0$) of the main insulating kraft paper (normal kraft paper). Consequently, since a harmful DC electric field is not shared with the low-resistance kraft paper, it is effective to restrain discharge in the voids.

When the resistivity ($\rho_1$) of the low-resistance kraft paper is larger than $0.7\rho_0$, it is too close to the volume resistivity ($\rho_0$) of the main insulating kraft paper to make no difference between their DC electric fields produced in proportion to resistance, so that the DC electric field of a sharp temperature change portion (a portion where voids are apt to be generated just above the conductor when a load is cut off), which is a target of the present invention, cannot be relieved. On the contrary, when the resistivity ($\rho_1$) is smaller than $0.1\rho_0$, substantially the whole DC stress is shared with the main insulating layer, and this low-resistance kraft paper layer cannot perform its essential role to share electric stress as an insulating layer at all. In addition, the dielectric strength against transiently incoming impulsive abnormal waves and against the DC voltage per se begins to decrease undesirably.

The low-resistance kraft paper having a resistivity within $0.1\rho_0 \leqq \rho_1 \leqq 0.7\rho_0$ with respect to the kraft paper of the main insulating layer can be obtained by adding a kind of additive to general kraft paper, or using a kind of dielectric kraft paper. In such a manner, it is possible to obtain low-resistance kraft paper which has a desired resistivity all over the temperature range when the cable is in use, and which has breakdown strength not inferior to those of conventional kraft paper with respect to both DC and impulses. Specifically, such low-resistance kraft paper may be obtained by adding amine to kraft paper, or by using cyanoethyl paper. Solid state properties of this low-resistance kraft paper and conventional kraft paper are compared and shown in Table 2.

TABLE 2

| thickness | | unit μm | 100 | 70 | 50 |
|---|---|---|---|---|---|
| | | low-resistance kraft paper | | | |
| dielectric constant | 20° C. | — | 4.14 | 4.21 | 4.26 |
| resistivity | 20° C. | Ω·cm | $2.8*10^{16}$ | $2.6*10^{16}$ | $2.4*10^{16}$ |
| | 80° C. | Ω·cm | $2.7*10^{16}$ | $2.4*10^{14}$ | $2.5*10^{14}$ |
| | 100° C. | Ω·cm | $1.2*10^{14}$ | $1.4*10^{14}$ | $1.3*10^{14}$ |
| DC-BD | 20° C. | kV/mm | 250 | 248 | 250 |
| Imp-BD | 20° C. | kV/mm | 204 | 213 | 221 |
| | | conventional kraft paper | | | |
| dielectric constant | 20° C. | — | 4.37 | 4.28 | 4.31 |
| resistivity | 20° C. | Ω·cm | $4.7*10^{16}$ | $4.2*10^{16}$ | $5.2*10^{16}$ |
| | 80° C. | Ω·cm | $5.1*10^{16}$ | $6.1*10^{14}$ | $5.9*10^{14}$ |
| | 100° C. | Ω·cm | $1.8*10^{14}$ | $2.1*10^{14}$ | $2.3*10^{14}$ |
| DC-BD | 20° C. | kV/mm | 266 | 272 | 261 |
| Imp-BD | 20° C. | kV/mm | 204 | 209 | 224 |

In such a manner, it is understood that the low-resistance kraft paper has a resistivity satisfying the relation of $0.1\rho_0 \leqq \rho_1 \leqq 0.7\rho_0$ all over the temperature range (generally, about 20 to 60° C.) when the cable is in use. Therefore, by using such low-resistance kraft paper, it is possible to form an insulating layer with which an electric field is not shared even if voids are generated. Accordingly, it is possible to restrain discharge in the voids.

Figure 6:
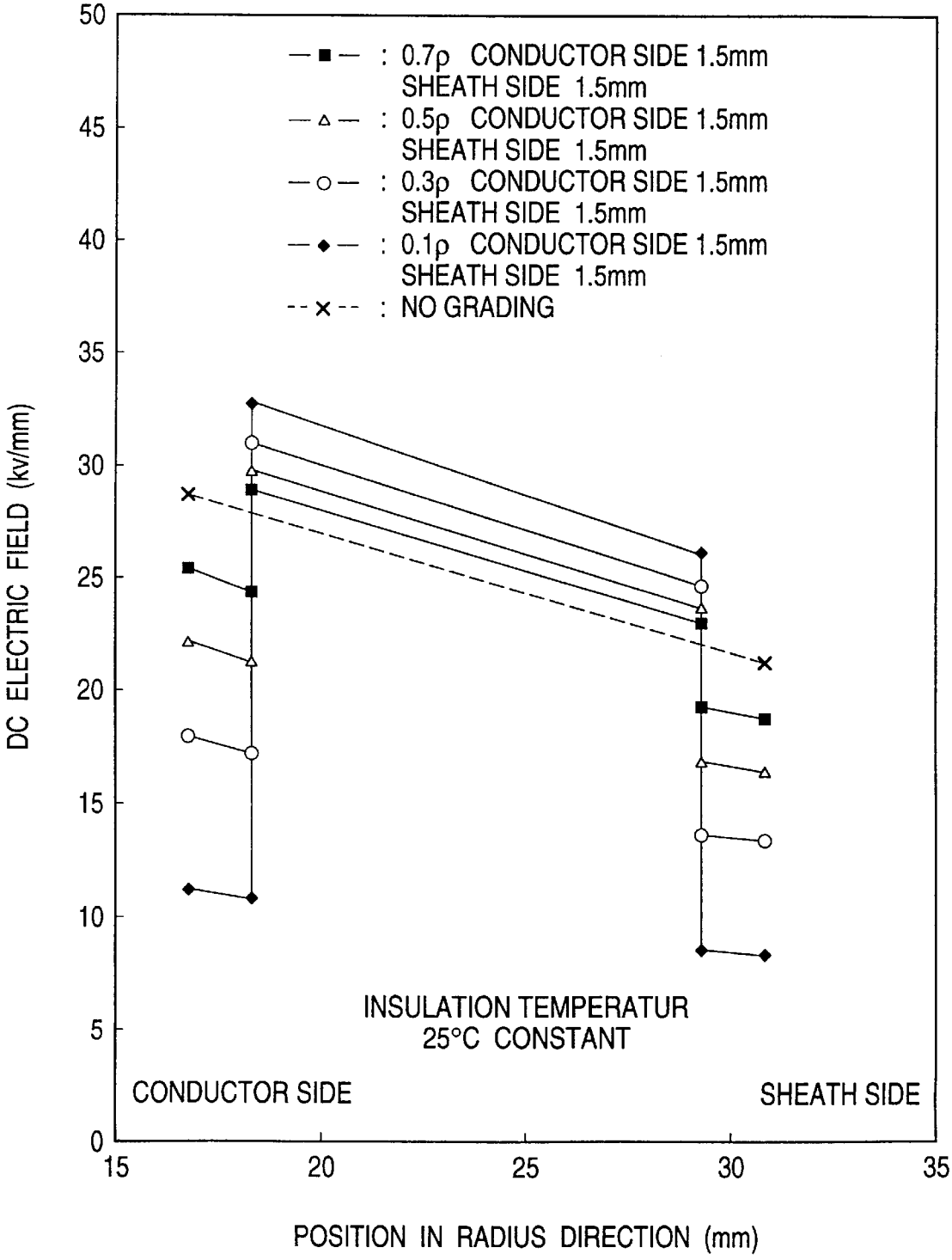
FIG. 6 is a graph showing the relationship between the difference in resistivity of the low-resistance kraft paper layer and the DC electric field distribution in the insulating layer in the same case of FIG. 4.

The region in which negative oil pressure occurs in the insulating layer and the percentages of the region from the conductor side which is occupied by the low-resistance kraft paper may be determined by calculation or experiment of trial cables after the service conditions, size and structure of the cable are determined. Generally, it is preferable to set the thickness of the thus wound low-resistance kraft paper to be 0.5 mm or more. If the thickness is smaller than 0.5 mm, it has been found by experiments and so on that a sharp change of conductor temperature upon cutting-off of a load as mentioned above cannot be absorbed in the low-resistance kraft paper. Generally, in order to absorb/relieve sufficiently the influence of the portion where the temperature drops suddenly when a load is cut off, it is preferable, from the investigation as shown in FIG. 6, to wind the low-resistance kraft paper to an extent of 10% of the thickness of the insulating layer. When the low-resistance kraft paper layer is increased more than 10% of the thickness of the insulating layer, the DC voltage shared with the low-resistance kraft paper layer is so small that the total number of wound sheets of the insulating layer which is a combination of the low-resistance kraft paper layer and the insulating tape layer as the main insulating layer becomes large, and the thickness of total insulation is also increased. When the number of these wound sheets is increased, a tape winding machine is too large in size or the efficiency of working is lowered when the cable is manufactured. In addition, the cable manufactured is large in size wastefully.

Further, preferably, the thickness of the low-resistance kraft paper used here is set to be about 50 to 150 μm. If the thickness is smaller than 50 μm, the material mechanical strength of the low-resistance kraft paper is reduced. If the thickness exceeds 150 μm, an oil gap in the low-resistance kraft paper layer becomes large undesirably.

The low-resistance kraft paper layer may be provided not only on the inner circumferential side of the main insulating layer but also on the outer circumferential side. The DC stress is higher on the inner circumferential side than on the outer circumferential side at room temperature, while it is higher on the outer circumferential side than on the inner circumferential side at high temperature. Without using low-resistance kraft paper, electric breakdown occurs in the portion where stress produced in the insulating layer is high, that is, in the innermost circumference of the insulating layer (at the time of non-load or low-load) or in the outermost layer (at the time of heavy-load). Therefore, the maximum stress occurs in the interface between the insulating layer and the conductor outer-circumferential surface or between the insulating layer and the metal sheath inner-circumferential surface, which is apt to be the weakest point in a general cable, so that electric breakdown is apt to occur there. By applying the low-resistivity kraft paper to this high-stress portion, (1) it is possible to reduce stress in the inner/outer interface of the insulating layer which is apt to be the weakest point, (2) it is possible to transfer the maximum stress point to the inside of the insulating layer which is essentially high in breakdown strength and has no irregular electric distribution, and (3) it is possible to relieve electric stress on the innermost circumferential side of the insulating layer where harmful voids are apt to be generated when load is cut off, as mentioned above. Therefore, to realize a high-reliability solid DC cable, it is effective to apply the low-resistance kraft paper layer to both the inner and outer sides of the insulating layer.

A mode for carrying out the present invention according to the second embodiment will be described below.

Figure 3:
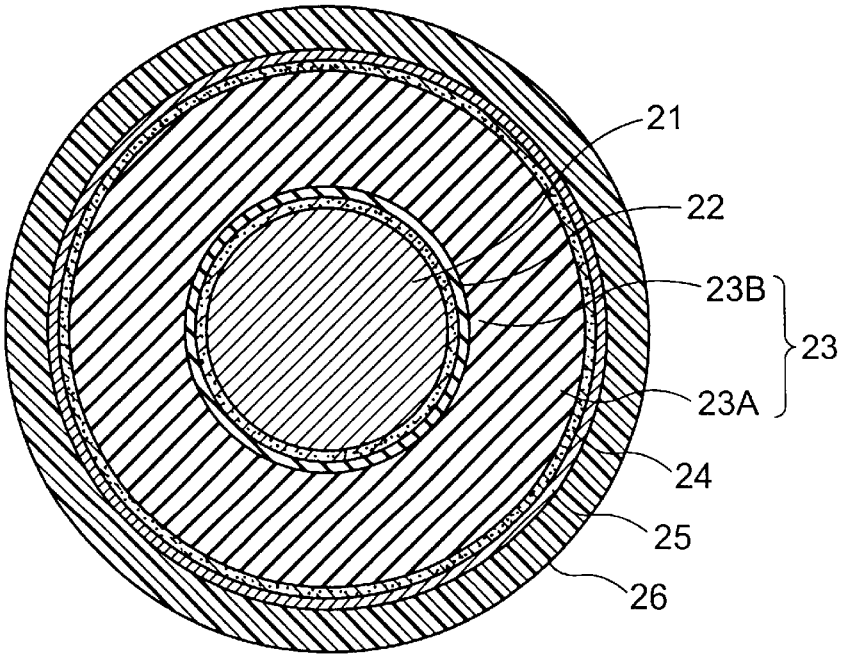
FIG. 3 is a sectional view of a solid DC cable of a second embodiment according to the present invention.

FIG. 3 is a sectional view of a solid DC cable according to the present invention. This cable is constituted by a conductor 21, an inner semiconductive layer 22, an insulating layer 23, an outer semiconductive layer 24, a metal sheath 25 and a plastic jacket 26 in the order from the inner circumference toward the outer circumference. The insulating layer 23 is constituted by a main insulating layer 23A on the outer circumferential side and a low-resistance kraft paper layer 23B on the inner circumferential side. The main insulating layer 23A is formed by winding normal kraft paper, while the low-resistance kraft paper layer 23B is formed by winding low-resistance kraft paper having a resistivity which is lower than that of the normal kraft paper of the main insulating layer 23A. Another low-resistance kraft paper layer may be provided between the main insulating layer 23A and the outer semiconductive layer 24.

EXPERIMENTAL EXAMPLE 2

Cables (Examples) having an insulating layer in which low-resistance kraft paper layers had been formed on both the inner circumference and outer circumference of a main insulating layer, and a cable (Comparative Example) having an insulating layer without any low-resistance kraft paper layer were made on trial, and DC breakdown characteristics were examined upon these cables. The conductor size of the cables was 800 $mm^2$, and the thickness of the kraft paper and the low-resistance kraft paper in the main insulating layer was 130 μm. As to the experimental conditions, the start voltage was −500 kV, a step-up condition was −100 kV/3 days, and a load cycle was 8 hour current circulation (70° C.) and 16 hour natural cooling (R.T). The cable structures and the experimental results are shown in Table 3.

TABLE 3

| | | Example 4 | Example 5 | Comp. Ex. 2 |
|---|---|---|---|---|
| cable structure | low-resistance paper (mm) (inner-circumferential side) | 0.5 | 1.5 | 0 |
| | main insulating layer (mm) | 13.0 | 12.0 | 14.0 |
| | low-resistance paper (mm) (outer-circumferential side) | 0.5 | 0.5 | 0 |
| | insulation thickness (mm) | 14.0 | 14.0 | 14.0 |
| | outer diameter (mm) | 61.7 | 61.7 | 61.7 |
| electrical test | DC-BD value (kV/mm) | −1,200 | −1,400 | −800 |

As shown in Table 3, Examples 4 and 5 are superior in the electric breakdown characteristics to Comparative Example 2, and it can be inferred that discharge is restrained even if voids are generated in a portion just above the conductor. Particularly, in Example 5, in which the thickness of the low-resistance kraft paper layer was made to be 1.5 mm, the effect to improve the DC breakdown value is more remarkable than any.

EXPERIMENTAL EXAMPLE 3

By using cables similar to those in Experimental Example 2, the relationship between the difference in thickness of the low-resistance kraft paper layer and a DC electric field in the insulating layer was examined. Herein, low-resistance kraft paper layers were provided both on the inner circumferential side (conductor side) and the outer circumferential side (sheath side) of the main insulating layer. The respective low-resistance kraft paper layers were made to be either 0.5 mm thick or 1.5 mm thick. As to the experimental conditions, the applied voltage was 350 kV DC, the conductor size was 800 $mm^2$, and the insulating layer thickness was 14.0 mm. In addition, a similar experiment was performed also upon a cable without any low-resistance kraft paper layer for the sake of comparison. The experimental results in the case where the temperature was set constant to be 25° C. is shown in FIG. 4, and the experimental results when the conductor temperature was set to 55° C. is shown in FIG. 5.

Figure 4:
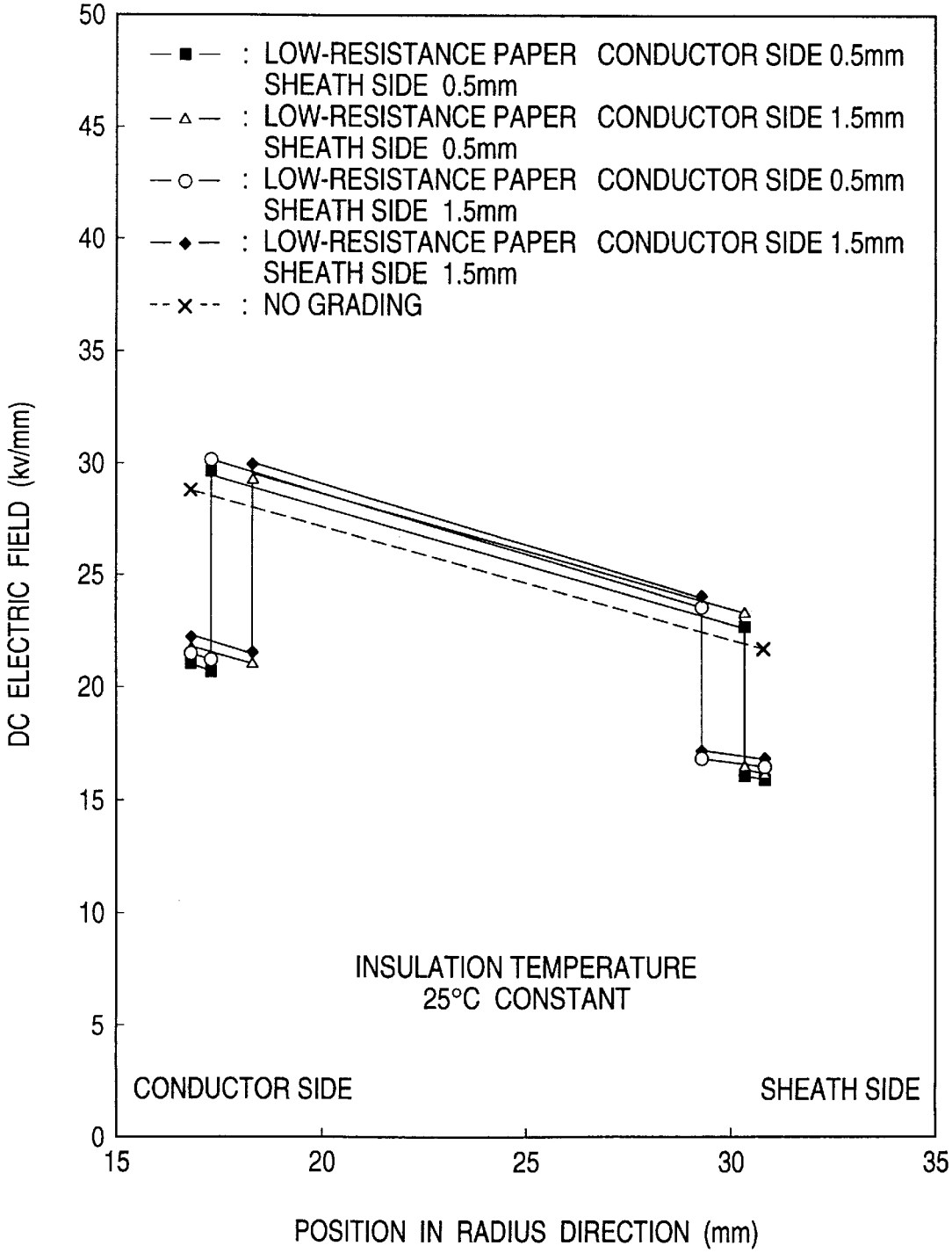
FIG. 4 is a graph showing the relationship between the positions in the insulating layer and DC electric field distributions in the case of the case of the combination of the main insulating layer and a low-resistance kraft paper layers on its both sides, with parameters of the difference in thickness of low-resistance kraft paper layers when the insulation temperature is constantly 25° C.
Figure 5:
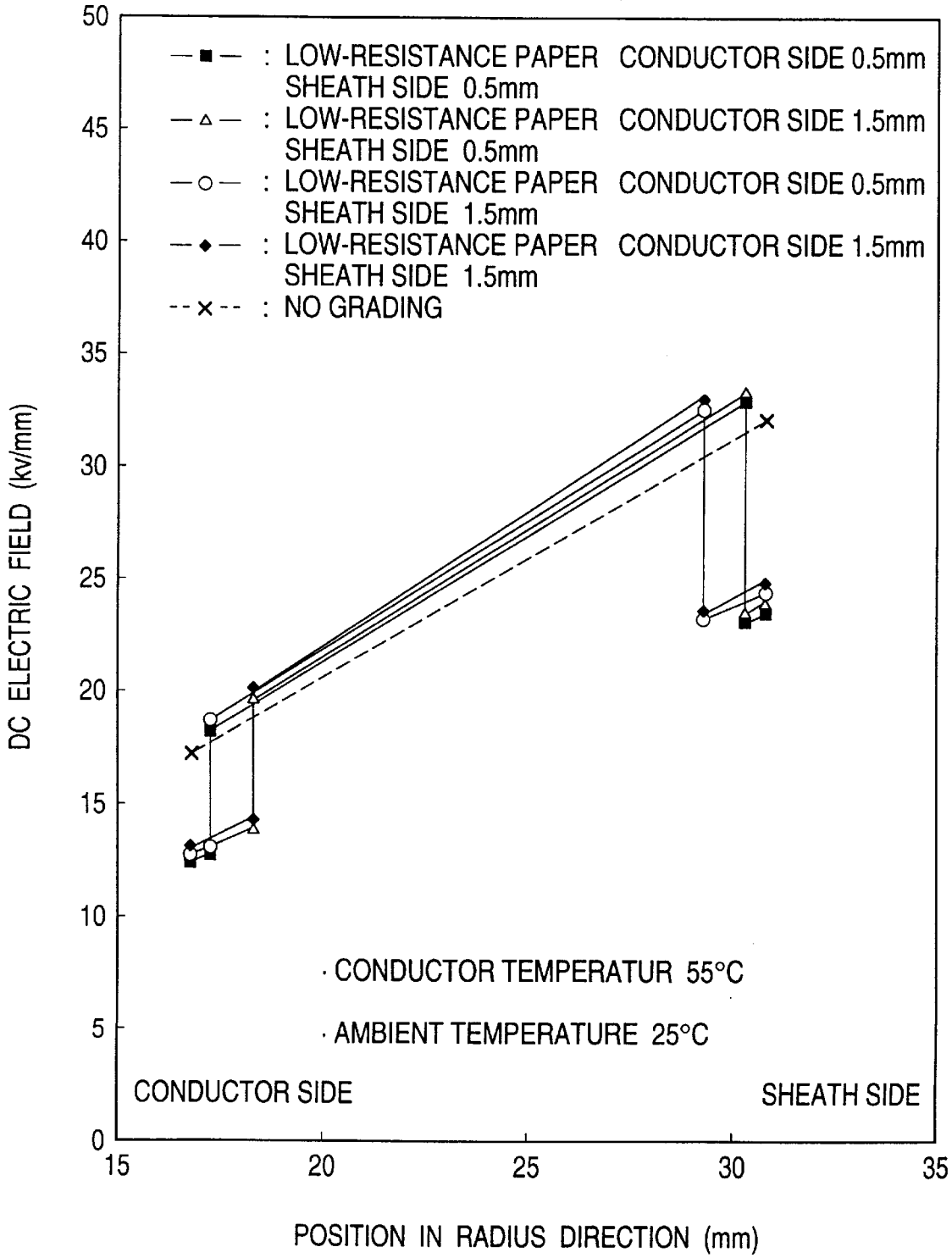
FIG. 5 is a graph showing the same relationship as in the FIG. 4 with on exception of conductor temperature to be 55° C.

As shown in FIGS. 4 and 5, the DC electric field strength is higher on the inner circumferential side of the insulating layer at the time of low temperature (FIG. 4), while it is higher on the outer circumferential side at the time of high temperature (FIG. 5). In addition, it is understood that in either of the above cases, the DC electric field is relieved by the low-resistance kraft paper layers. Particularly, it is understood that, in order to relieve an electric field in the interface between the insulating layer and the metal sheath, which is a weak point at the time of high temperature, it is effective to provide another low-resistance kraft paper layer on the outer circumferential side of the main insulating layer.

EXPERIMENTAL EXAMPLE 4

Figure 7:
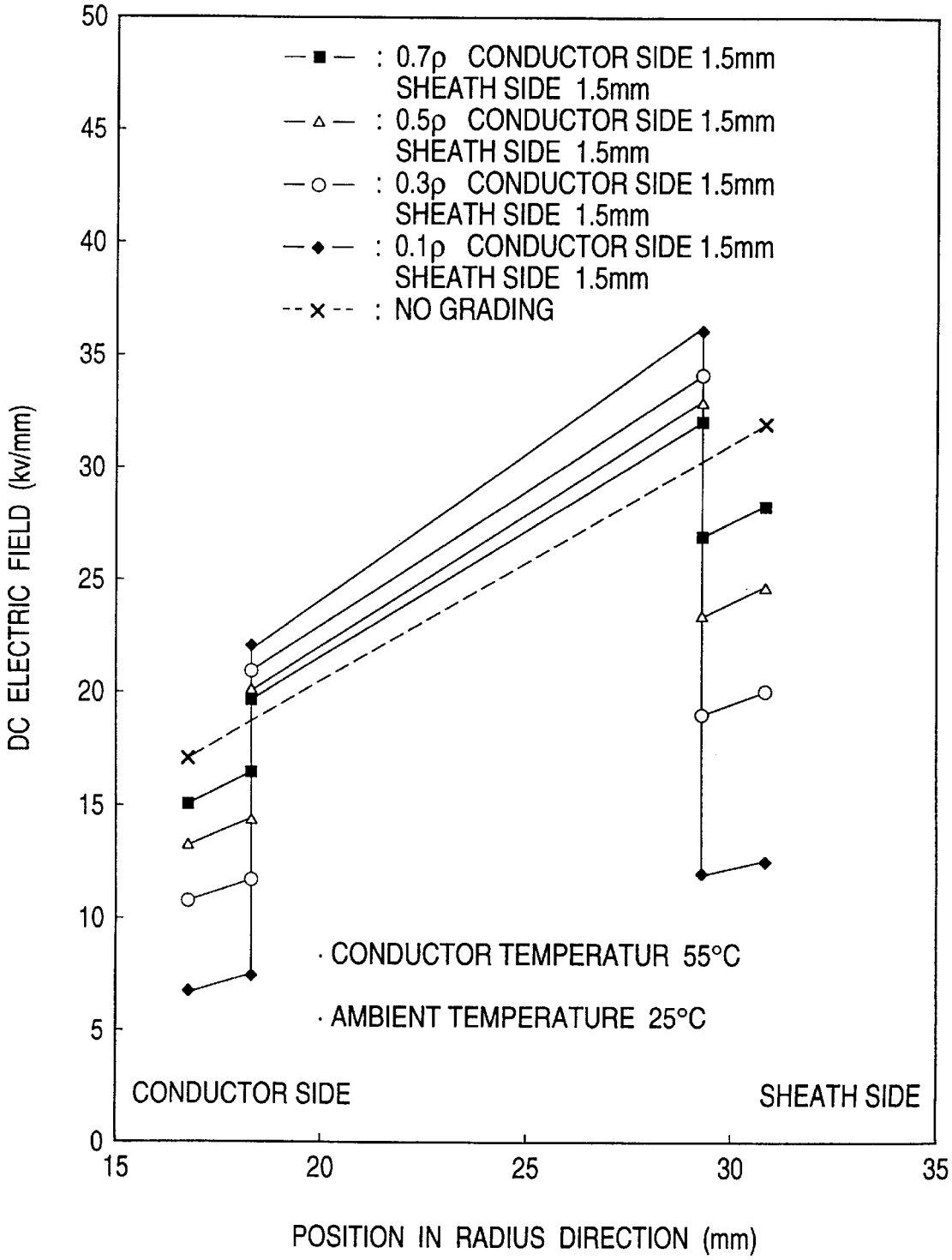
FIG. 7 is a graph showing the relationship between the difference in resistivity of the low-resistance kraft paper layer and the DC electric field distribution in the insulating layer in the same case of FIG. 5.
Figure 8:
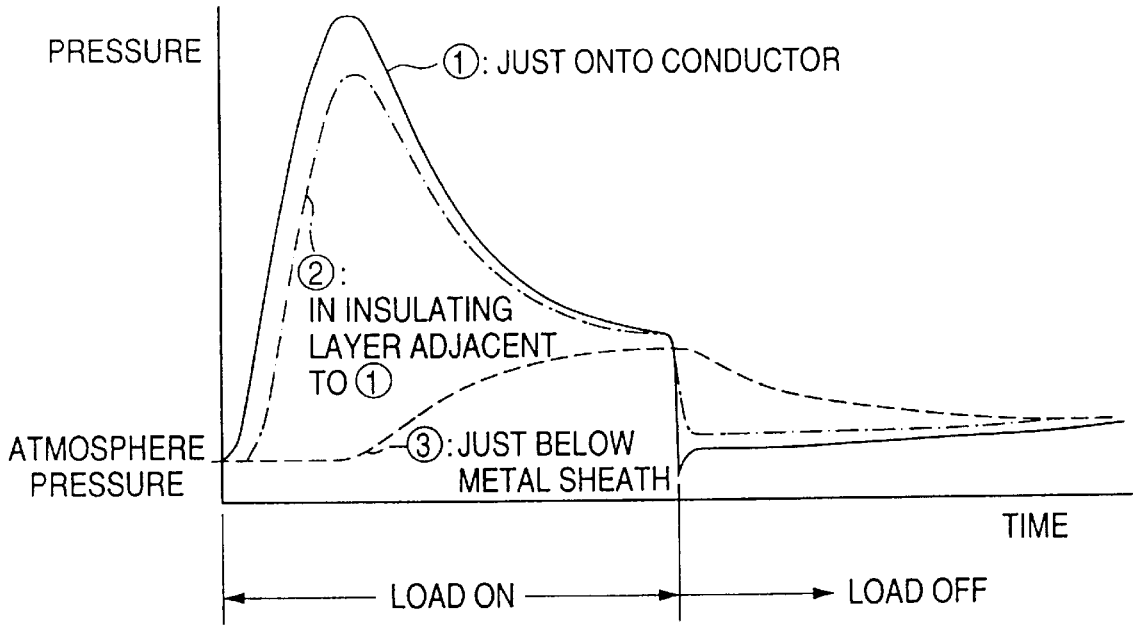
FIG. 8 is a graph showing a change of oil pressure with the laps of time in the insulating layer just above the conductor, adjacent to the layer and just below the metal sheath when a load current is applied and then stopped after the sufficient time lapsed from the start of the current application.

By using cables similar to those in Experimental Example 2, the relationship between the difference in resistivity of the low-resistance kraft paper layer and a DC electric field in the insulating layer was examined. Herein, various low-resistance kraft paper having a resistivity of 0.1 times, 0.3 times, 0.5 times, and 0.7 times, respectively, as large as the resistivity of the main insulating layer kraft paper. Low-resistance kraft paper layers were provided both on the inner circumferential side and the outer circumferential side of the main insulating layer. Each of the respective low-resistance kraft paper layers was 1.5 mm thick. In addition, a comparative example without any low-resistance kraft paper layer was also examined in the same experimental conditions as in Experimental Example 3. The experimental results in the case where the temperature was set to be constant at 25° C. is shown in FIG. 6, and the experimental results when the conductor temperature was set to 55° C. is shown in FIG. 7.

Also in this experiment, at the time of low temperature (FIG. 6), the DC electric field strength is higher on the inner circumferential side of the insulating layer, while at the time of high temperature (FIG. 7), the DC electric field strength is higher on the outer circumferential side. In addition, it is understood that, in either of the above cases, the resistivity within the examined range is effective to relieve a DC electric field in the interface between the insulating layer and the conductor or the metal sheath.

As has been described above, according to a solid DC cable of the present invention, it is possible to restrain discharge even if negative oil pressure occurs in an insulating layer to thereby generate harmful voids when load is cut off, and it is possible to relieve an electric field in the interface between the insulating layer and a conductor and in the interface between the insulating layer and a metal sheath, which interfaces are electrically weak points of the cable. Accordingly, it is possible to configure a power cable which is high in the electric breakdown strength, and suitable for large-electric power and long-distance transmission.

Third Embodiment

Third embodiment according to the present invention will be described as follows.

Usually, in the state in which an electrically insulating composite tape, i.e., the above described PPLP, has been impregnated with insulating oil, the volume resistivity of the insulating composite tape is about $10^{15}$ Ω·cm or more within the service temperature range. Therefore, as the low-resistance kraft paper, normal kraft paper having a resistivity which is one or more figures lower than that of this composite tape, for example, about $10^{13}$ Ω·cm is used. In addition, the low-resistance kraft paper as used in the second embodiment can be used as the kraft paper. Because DC electric field is shared in proportion to resistance in each position of the insulating layer, the DC electric field is not shared with the kraft paper layer having a low resistivity, so that discharge in voids can be restrained.

The region in which negative oil pressure occurs in the insulating layer and the percentages of the region from the conductor side which is occupied by the kraft paper may be determined by calculation or experiment of trial cables after the service conditions, size and structure of the cable are determined. Generally, it is preferable to set the thickness of the thus wound kraft paper to be 0.8 mm or more. If the thickness is smaller than 0.8 mm, it has been found by experiments and so on that a sharp change of conductor temperature upon cutting-off of a load as mentioned above cannot be absorbed in the kraft paper. Generally, in order to absorb/relieve sufficiently the influence of the portion where the temperature drops suddenly when a load is cut off, it is preferable to wind the kraft paper to an extent of 10% of the thickness of the insulating layer. When the kraft paper layer is increased to more than 10% of the thickness of the insulating layer, the DC voltage shared with the kraft paper layer is so small that the total number of wound sheets of the insulating layer which is combination of the kraft paper layer and the main insulating layer becomes large, and the total thickness of insulation is also increased. When the number of these wound sheets is increased, a tape winding machine is too large in size or the efficiency of working is lowered when the cable is manufactured. In addition, the cable manufactured is large in size wastefully.

Further, preferably, the thickness of the kraft paper used here is set to be about 50 to 150 μm. If the thickness is smaller than 50 μm, the material mechanical strength of the kraft paper is reduced. If the thickness exceeds 150 μm, an oil gap in the kraft paper layer becomes large undesirably.

The kraft paper layer may be provided not only on the inner circumferential side of the main insulating layer but also on the outer circumferential side. The DC stress is higher on the inner circumferential side than on the outer circumferential side at room temperature, while it is higher on the outer circumferential side than on the inner circumferential side at high temperature. Without providing any kraft paper layer, electric breakdown occurs in the portion where stress produced in the insulating layer is high, that is, in the innermost circumference of the insulating layer (at the time of non-load or low-load) or in the outermost layer (at the time of heavy-load). Therefore, the maximum stress occurs in the interface between the insulating layer and the conductor outer-circumferential surface or between the insulating layer and the metal sheath inner-circumferential surface, which is apt to be the weakest point in a general cable, so that electric breakdown is apt to occur there. By applying the kraft paper having a resistivity lower than that of the main insulating layer to this high-stress portion, (1) it is possible to reduce stress in the inner/outer interface of the insulating layer which is apt to be the weakest point, (2) it is possible to transfer the maximum stress point to the inside of the insulating layer which is essentially high in breakdown strength and has no irregular electric stress distribution, and (3) it is possible to relieve electric stress on the innermost circumferential side of the insulating layer where harmful voids are apt to be generated when load is cut off, as mentioned above. Therefore, to realize a high-reliability solid DC cable, it is effective to apply the kraft paper layer to both the inner and outer sides of the insulating layer.

A mode for carrying out the present invention according to the third embodiment will be described below.

Figure 9:
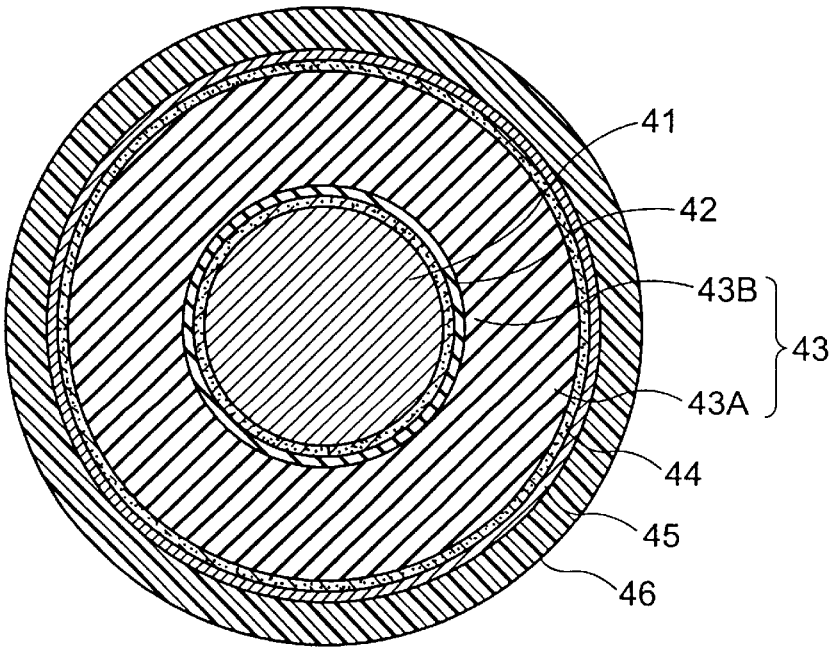
FIG. 9 is a sectional view of a solid DC cable of a third embodiment according to the present invention.

FIG. 9 is a sectional view of a solid DC cable according to the present invention. This cable is constituted by a conductor 41, an inner semiconductive layer 42, an insulating layer 43, an outer semiconductive layer 44, a metal sheath 45 and a plastic jacket 46 in the order from the inner circumference toward the outer circumference. The insulating layer 43 is constituted by a main insulating layer 43A on the outer circumferential side and a kraft paper layer 43B on the inner circumferential side. The main insulating layer 43A is formed by winding a composite tape (trade name: PPLP) in which polypropylene film and kraft papers on its both sides are bonded with each other, while the kraft paper layer 43B is formed by winding kraft paper having a resistivity which is about one figure lower than that of the composite tape of the main insulating layer 43A. Another low-resistance kraft paper layer may be provided between the main insulating layer 43A and the outer semiconductive layer 44.

EXPERIMENTAL EXAMPLE 5

Cables (Examples) each having an insulating layer in which kraft paper layers different in thickness are formed both on the inner and outer circumferences of a main insulating layer, and a cable (Comparative Example) having an insulating layer (constituted only by a composite tape) without any kraft paper layer were made on trial, and DC breakdown characteristics were examined upon these cables. The conductor size of the cables was 800 $mm^2$, and the thickness of the kraft paper was 130 μm. As to the experimental conditions, start voltage was −500 kV, a step-up condition was −100 kV/3 days, and a load cycle was 8 hour current circulation (70° C.) and 16 hour natural cooling (R.T). The cable structures and the experimental results are shown in Table 4.

| | | Example 6 | Example 7 | Example 8 | Comp. Ex. 3 |
|---|---|---|---|---|---|
| cable structure | kraft paper (mm) (inner-circumferential side) | 0.8 | 1.5 | 0.3 | 0 |
| | main insulating layer (mm)(PPLP) | 12.7 | 12.0 | 13.2 | 14.0 |
| | kraft paper (mm) (outer-circumferential side) | 0.5 | 0.5 | 0.5 | 0 |
| | insulating layer thickness (mm) | 14.0 | 14.0 | 14.0 | 14.0 |
| | outer diameter (mm) | 61.7 | 61.7 | 61.7 | 61.7 |
| electrical test | DC-BD value (kV/mm) | −1,600 | −1,800 | −1,100 | −800 |

As shown in Table 4, Examples 6, 7 and 8 are superior in the electric breakdown characteristics to Comparative Example 3, and it can be inferred that discharge is restrained even if voids are generated in a portion just above the conductor. Particularly, in Examples 6 and 7 in which the thickness of the kraft paper layer on the inner circumferential side was made 0.8 mm or more, the effect to improve the DC breakdown strength is more remarkable than that in the other Examples.

As has been described above, according to a solid DC cable of the present invention, it is possible to restrain discharge even if negative oil pressure is generated in an insulating layer to thereby generate harmful voids when a load is cut off, and it is possible to relieve an electric field in the interface between the insulating layer and a conductor, which is an electrically weak point of the cable. Accordingly, it is possible to form a power cable which is high in the electric breakdown strength, and suitable for large-electric power and long-distance transmission. Particularly, in the case where another kraft paper layer is formed also on the outer circumference of the main insulating layer, it is possible to relieve an electric field in the interface between the insulating layer and a metal sheath. Accordingly, it is possible to obtain a cable superior in the electric breakdown strength both at the time of non(low)-load and at the time of high-load.

What is claimed is:

1. A solid DC cable comprising a conductor and an insulating component provided on an outer circumference of a conductor; wherein the insulating component comprises a combination selected from the group consisting of:

(1) a main insulating layer comprising kraft paper, and a low-resistance tape layer, wherein said low-resistance tape layer comprises carbon paper having a volume resistivity which is smaller than that of said main insulating layer;

(2) a main insulating layer comprising kraft paper, and a low-resistance insulating layer comprising low-resistance kraft paper having a resistivity smaller than that of the kraft paper of said main insulating layer;

(3) a main insulating layer comprising a composite tape in which low-loss plastic film and kraft paper are bonded, and a low-resistance insulating layer comprising kraft paper having a resistivity lower than that of said main insulating layer; or (4) a low-resistance tape layer comprising the carbon paper in (1) above, a low resistance insulating layer comprising the low-resistance kraft paper in (2) above, and a main insulating layer, the low-resistance tape layer, the low-resistance insulating layer and the main insulating layer being successively layered on said conductor;

wherein at least one of the low-resistance insulating layer and the low-resistance tape layer is layered above the conductor in a region where a void in an insulating oil in the insulating component may develop because pressure of the insulating oil becomes negative when a load is cut off.

2. A solid DC cable according to claim 1, wherein said insulating component comprises (1) a main insulating layer, comprising kraft paper, and a low-resistance tape layer, wherein said low-resistance tape layer comprises a carbon paper having a volume resistivity which is smaller than that of said main insulating layer;

wherein said main insulating layer further comprises at least one kraft paper and a composite tape in which a low-loss plastic film and a kraft paper are bonded.

3. A solid DC cable according to claim 2, wherein the carbon paper having a volume resistivity in a range of from $10^3$ to $10^8$ Ω·cm is wound to a thickness of 0.8 mm or more.

4. A solid DC cable according to claim 2, wherein the carbon paper is wound to a thickness of 10% or less than that the main insulating layer.

5. A solid DC cable according to claim 2, wherein the carbon paper has a thickness of from 50 μm to 150 μm.

6. A solid DC cable according to claim 1, wherein the insulating layer comprises (2) a main insulating component comprising a normal kraft paper, and a low-resistance insulating layer, wherein said low-resistance insulating layer comprises a low-resistance kraft paper having a resistivity lower than that of said kraft paper of the main insulating layer;

said solid DC cable further comprising a metal sheath on an outer circumference of said insulating component; and said low-resistance kraft paper being located just below said metal sheath, or just below an outer semiconductive layer.

7. A solid DC cable according to claim 6, wherein a resistivity ($\rho_1$) of the low-resistance kraft paper and a resistivity ($\rho_0$) of the normal kraft paper of the main insulating layer have a relationship of $0.1\rho_0 \leqq \rho_1 \leqq 0.7\rho_0$.

8. A solid DC cable according to claim 6, wherein has a thickness of from the low-resistance kraft paper layer 0.5 mm or more.

9. A solid DC cable according to claim 6, wherein the low-resistance kraft paper is wound to a thickness which is 10% or less of a thickness of the insulating component.

10. A solid DC cable according to claim 6, wherein the low-resistance kraft paper is amine-added paper.

11. A solid DC cable according to claim 6, wherein the low-resistance kraft paper is cyanoethyl paper.

12. A solid DC cable according to claim 6, wherein a thickness of the low-resistance kraft paper is in the range of 50 to 150 μm.

13. A solid DC cable according to claim 1, wherein the insulating component comprises (3) the main insulating layer comprising a composite tape in which low-loss plastic film and kraft paper are bonded, and a low-resistance insulating layer comprising kraft paper having a resistivity lower than that of said main insulating layer.

14. A solid DC cable according to claim 13, further comprising a kraft paper layer on an outer circumference of the main insulating layer being wound to a thickness of 10% or less of a thickness of the insulating component.

15. A solid DC cable according to claim 13, wherein a thickness of the low-resistance insulating layer is 0.8 mm or more.

16. A solid DC cable according to claim 13, wherein the kraft paper is wound to a thickness which is 10% or less than that of the insulating layer.

17. A solid DC cable according to claim 13, wherein a resistivity ($\rho_1$) of the kraft paper of the low-resistance insulating layer and a resistivity ($\rho_0$) of the normal kraft paper have a relationship of $0.1\ \rho_0 \leqq \rho_1 \leqq 0.7\rho_0$.

18. A solid DC cable according to claim 17, wherein the low-resistance kraft paper is amine-added paper.

19. A solid DC cable according to claim 17, wherein the low-resistance kraft paper is cyanoethyl paper.

20. A solid DC cable according to claim 13, wherein the low-resistance kraft paper has a thickness of from 50 μm to 150 μm.

21. A solid DC cable comprising a conductor and an insulating layer provided on an outer circumference of the conductor, wherein the insulating layer comprises:

a main insulating layer comprising kraft paper;

a low-resistance insulating layer comprising low-resistance kraft paper having a resistivity smaller than that of the kraft paper of the main insulating layer; and a metal sheath on an outer circumference of said insulating layer, said low-resistance kraft paper being located just below said metal sheath or just below an outer semiconductive layer, wherein the low-resistance insulating layer is layered above the conductor in a region where the pressure of an insulating oil becomes negative when a load is cut off, and the low-resistance kraft paper is cyanoethyl paper.

22. A solid DC cable comprising a conductor and an insulating layer provided on an outer circumference of a conductor, wherein the insulating layer comprises:

a main insulating layer comprising a composite tape in which low-loss plastic film and kraft paper are bonded; and a low-resistance insulating layer comprising kraft paper having a resistivity lower than that of the main insulating layer, wherein the low-resistance insulating layer is layered above the conductor in a region where a pressure of an insulating oil becomes negative when a load is cut off, a resistively ($\rho_1$) of the kraft paper of the low-resistance insulating layer and a resistivity ($\rho_0$) of the normal kraft paper have a relationship of $0.1\rho_0 \leqq \rho_1 \leqq 0.7\rho_0$, and the low-resistance kraft paper is cyanoethyl paper.

23. A solid DC cable having a conductor and an insulating component, the insulating component comprising:

a main insulating layer comprising one of kraft paper a composite tape having low-loss plastic film bonded with kraft paper; and a low-resistance layer having a resistivity less than that of the main insulating layer the low-resistance layer comprising at least one of carbon paper, kraft paper, low-resistance kraft paper and a tape layer having carbon paper and a low-resistance kraft paper, wherein the low resistance layer is layered above the conductor in a region where a pressure of an insulating oil becomes negative when a load is cut off so that the low-resistance layer helps to: 1) avoid a sharp change of temperature of the conductor that would otherwise be applied to the insulating component and 2) reduce shrinkage of the insulating oil so that a void in the insulating oil is not apt to occur in the insulating component.

* * * * *